US006364310B1

(12) United States Patent
Forbes

(10) Patent No.: US 6,364,310 B1
(45) Date of Patent: Apr. 2, 2002

(54) APPARATUS FOR JOGGING MAIL

(75) Inventor: John R. H. Forbes, Media, PA (US)

(73) Assignee: Opex Corporation, Moorestown, NJ (US)

( * ) Notice: Subject to any disclaimer, the term of this patent is extended or adjusted under 35 U.S.C. 154(b) by 0 days.

(21) Appl. No.: 09/325,589

(22) Filed: Jun. 3, 1999

(51) Int. Cl.[7] ..... B65H 1/02
(52) U.S. Cl. ..... 271/210; 366/110; 271/207
(58) Field of Search ..... 366/110, 111, 366/127; 271/210, 207

(56) References Cited

U.S. PATENT DOCUMENTS

| | | | | | |
|---|---|---|---|---|---|
| 3,138,366 | A | * | 6/1964 | Karlstrom et al. | 259/1 |
| 3,500,993 | A | * | 3/1970 | Tarzian | 198/220 |
| 3,559,984 | A | * | 2/1971 | Westra | 271/89 |
| 3,862,752 | A | * | 1/1975 | Totten | 271/210 |
| 4,013,171 | A | | 3/1977 | Ferrin | |
| 4,345,753 | A | * | 8/1982 | Marshall | 271/146 |
| 4,420,262 | A | * | 12/1983 | Sterrenberg | 366/110 |
| 4,619,532 | A | * | 10/1986 | Schmidt, III | 366/110 |
| 5,238,302 | A | * | 8/1993 | Rohan | 366/110 |
| 5,456,532 | A | * | 10/1995 | Powers et al. | 366/110 |
| 5,622,269 | A | * | 4/1997 | Seymour et al. | 209/680 |
| 5,813,759 | A | * | 9/1998 | Gebrian | 366/208 |
| 6,073,776 | A | * | 6/2000 | Seymour et al. | 209/680 |

FOREIGN PATENT DOCUMENTS

| | | | | |
|---|---|---|---|---|
| DE | 2504971 | * | 8/1976 | 271/210 |
| IT | 607040 | * | 6/1958 | 271/210 |
| JP | 0023077 | * | 1/1986 | 271/210 |

OTHER PUBLICATIONS

FMC Product Specification "Syntron Vibrating Paper Joggers", pp. 1,11–18, published prior to Jun. 3, 1999.
Lectrojog, Product Specification "Wood and Metal Top Joggers", pp. 1 and 9 published prior to Jun. 3, 1999.
Lynde–Ordway, Product Specification "Low Profile Jogger", 1pg. published prior to Jun. 3, 1999.
Lynde–Ordway, Product Specification "Challenge Joggers" 1 pg. published prior to Jun. 3, 1999.
Martin Yale Industries, Inc., Product Specification "Business and Graphics Productions 1996" 3 pgs., published prior to Jun . 3, 1999.
The Cleveland Vibrator Company Product Specification "Tables and Packers" 2 pgs., published prior to Jun. 3, 1999.

* cited by examiner

*Primary Examiner*—Joseph E. Valenza
*Assistant Examiner*—Rashmi Sharma
(74) *Attorney, Agent, or Firm*—Dann, Dorfman, Herrell and Skillman, P.C.

(57) ABSTRACT

An apparatus is provided for jogging elements to settle or align the elements. The apparatus includes a vibrating element and an input bin for receiving the elements to be jogged. The apparatus further includes an elongated element disposed between the vibrating element and the input bin separating the input bin from the vibrating element. Wherein, the elongated element transmits the vibrations from the vibrating element to the input bin such that the vibrations jog the elements in the input bin.

18 Claims, 3 Drawing Sheets

APPARATUS FOR JOGGING MAIL

FIELD OF THE INVENTION

The present invention relates to a device for vibrating or jogging contents to settle the contents. More specifically, the present invention relates to a device for jogging stacks of mail to align the stacks of mail along one or two edges to prepare the stacks of mail for further processing by automated or semi-automated devices.

BACKGROUND

Jogging devices utilize vibrations to settle contents in a variety of environments. For example, the food processing industry utilizes joggers to settle foods, such as coffee and snack foods, prior to shipping. In addition, joggers are utilized to align stacks of documents in a wide range of environments. For instance, when processing standardized tests or other forms, it is typically necessary to have the documents in the stack aligned along at least one edge prior to entering the documents into a device for automatically evaluating the documents. Similarly, when processing mail using automated or semi-automated mail it is desirable to have the individual pieces of mail in a stack aligned along one edge prior to inputting the documents into the mail processing devices. By aligning the mail along at least one edge, it is less likely that the contents of an envelope will be cut when an envelope is cut open.

Jogging devices are normally fairly heavy. When the device is stored and used on a table top, the weight of the jogger is not a concern. For transportable devices, it is desirable to maintain the input bin at a height that is readily usable to a user. This has led to a variety of transportable joggers that are either unstable or cumbersome. In addition, the vibrations used to jog the items generally create significant noise that worsen the workplace environment of the user.

SUMMARY OF THE INVENTION

In light of the foregoing, the present invention provides an improved apparatus for jogging elements. The jogging apparatus includes a vibrating element operable to provide vibrations. The apparatus also includes in input bin for receiving the elements to be jogged. An elongated member disposed between the base and the input bin separates the input bin from the vibrating element. The vibrating element creates vibrations that act upon the elements in the input bin to jog the elements.

BRIEF DESCRIPTION OF THE DRAWINGS

The foregoing summary, as well as the detailed description set forth below, will be better understood when read in conjunction with the figures in which.

DETAILED DESCRIPTION OF THE PREFERRED EMBODIMENTS

Figure 1:
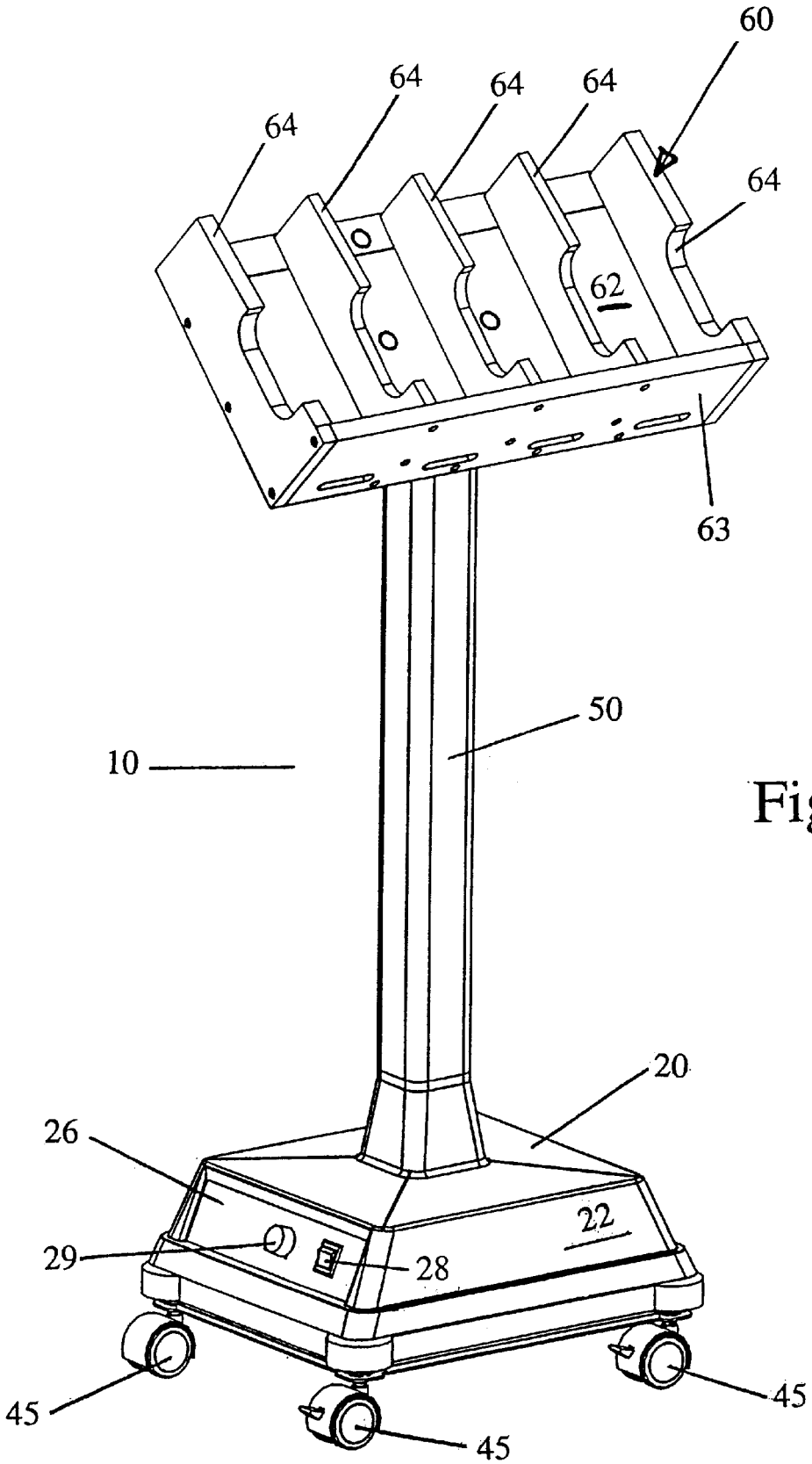
FIG. 1 is a perspective view of a jogging device according to the present invention.

Referring to the figures in general, and to FIG. 1 specifically, a jogging device is designated generally 10. The device 10 includes a base 20, a support column 50 and an input bin 60 for receiving a number of workpieces, such as documents. The support column 50 extends between the base 20 and the input bin 60, supporting the input bin at a convenient height for the user. The base 20 includes a vibration element. Vibrations from the vibration element are transferred through the support column 50 to the input bin 60 to jog the documents in the input bin.

Figure 2:
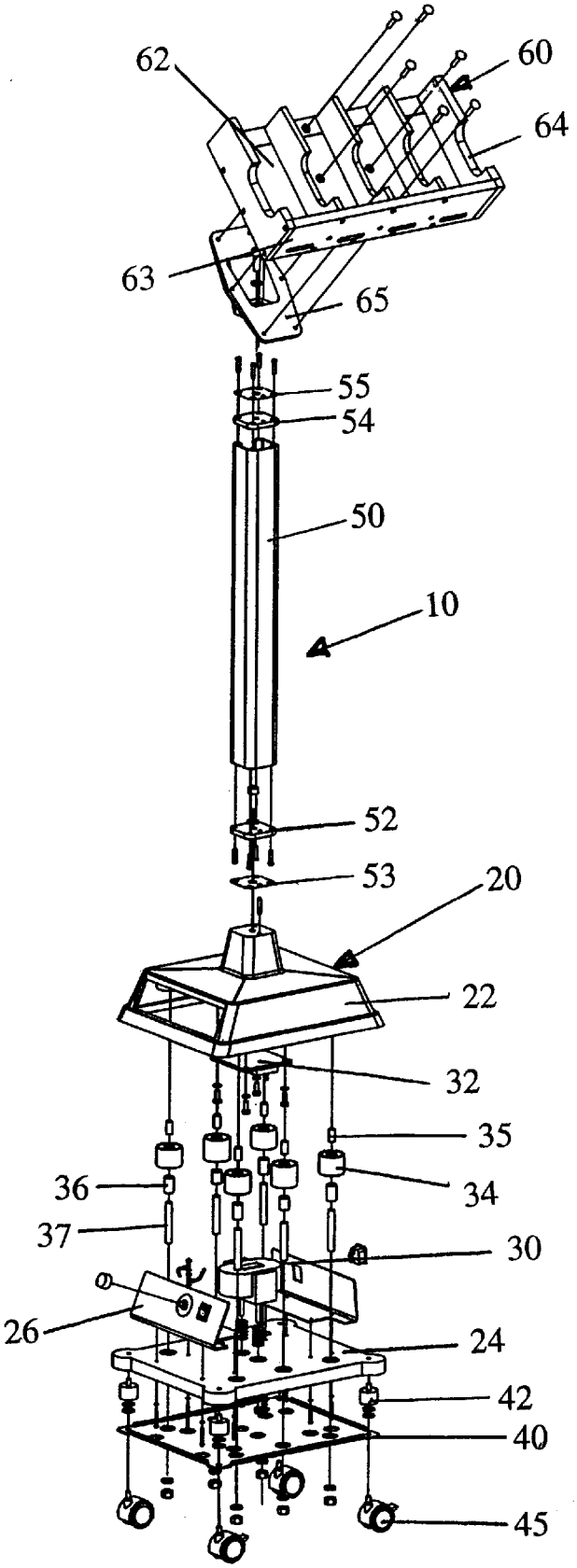
FIG. 2 is an exploded perspective view of the jogging device illustrated in FIG. 1.

The details of the base 20 are seen most clearly in FIG. 2. The base includes a base plate 24, a cover 22 for covering the contents of the base, and a subplate 40. The base plate 24 is generally planar. A vibrating element 30 in the form of an electromagnet is attached to the middle of the base plate 24. The electromagnet attracts an armature 32 attached to the cover 22. The current of the power supplied to the electromagnet 30 is alternating so that the magnetic force of the electromagnet operating upon the armature 32 varies. Based on the varying magnetic forces, the electromagnet 30 provides vibrations as discussed further below.

The cover 22 is attached to the base plate 24 as follows. A plurality of short studs 35 attached to the cover 22 engage a plurality of compressible spacers 34. A plurality of long studs 37 connected to the base plate 24 engage a plurality of spacers 36 and compressible spacers 34. Connected in this way, the compressible spacers 34 allow the cover 22 to displace vertically relative to the base plate 24.

When the electromagnet 30 is off, the compressible spacers 34 are substantially uncompressed. When power is supplied to the electromagnet 30 the variable magnetic forces of the electromagnetic operate on the armature 32. The compressible spacers 34 are resiliently compressible. When the magnetic force of the electromagnet 30 is relatively high, the attraction between the armature 32 and the electromagnet displaces the armature downwardly toward the electromagnet thereby compressing the compressible spacers 34. When the magnetic force of the electromagnet is relatively low, the resiliency of the compressible spacers 34 is greater than the magnetic attraction between the electromagnetic and the armature 32 so that the compressible spacers 34 expand, displacing the armature 32 upwardly. In this way, the varying attraction between the electromagnet and the armature reciprocally displace the armature 32 and the attached cover 22, relative to the base plate 24. This reciprocal displacement provides the vibrations that are transmitted to the input bin 60 to jog the documents in the bin.

The base 20 includes a control panel 26 for controlling operation of the vibrating element. The control panel includes an on/off switch 28 and a knob 29 for controlling the frequency of the vibrations. Operating the knob 29 varies the frequency of the vibrations between a minimum of several hundred hertz to a maximum of several thousand hertz.

A plurality of casters 45 are connected to the base plate 24. The casters 40 may be attached directly to the base plate 24. However, to reduce noise between the floor of the room and the device due to the vibrations, the base 20 includes a subplate 40 and a plurality of rubber dampeners 42. The casters 45 are attached to the subplate 40 and the subplate is attached to the base plate 24 via the rubber dampeners 42 that dampen the vibrations transmitted to the subplate and the attached casters 45.

The elongated support column 50 is attached to the top of the base 20. The support column 50 is an elongated extruded aluminum element in the form of a C-shaped channel. The support column 50 is elongated to support the input bin 60 at an appropriate height for an operator to place documents in the input bin. Accordingly, the height of the support column 50 is greater than the height of the base 20 and preferably is at least two to four times the height of the base 20. In the present instance, the the support calm 50 is approximately three times the height of the base 20.

A bottom cap 52 is fixedly connected to the bottom of the support column 50. The bottom cap 52 is also connected to the cover 22 of the base 20. Preferably a gasket 55 is disposed between the bottom cap 52 of the support calm 50 and the top of the cover 22. In this way, the support column 50 is rigidly attached to the base 20.

Figure 3:
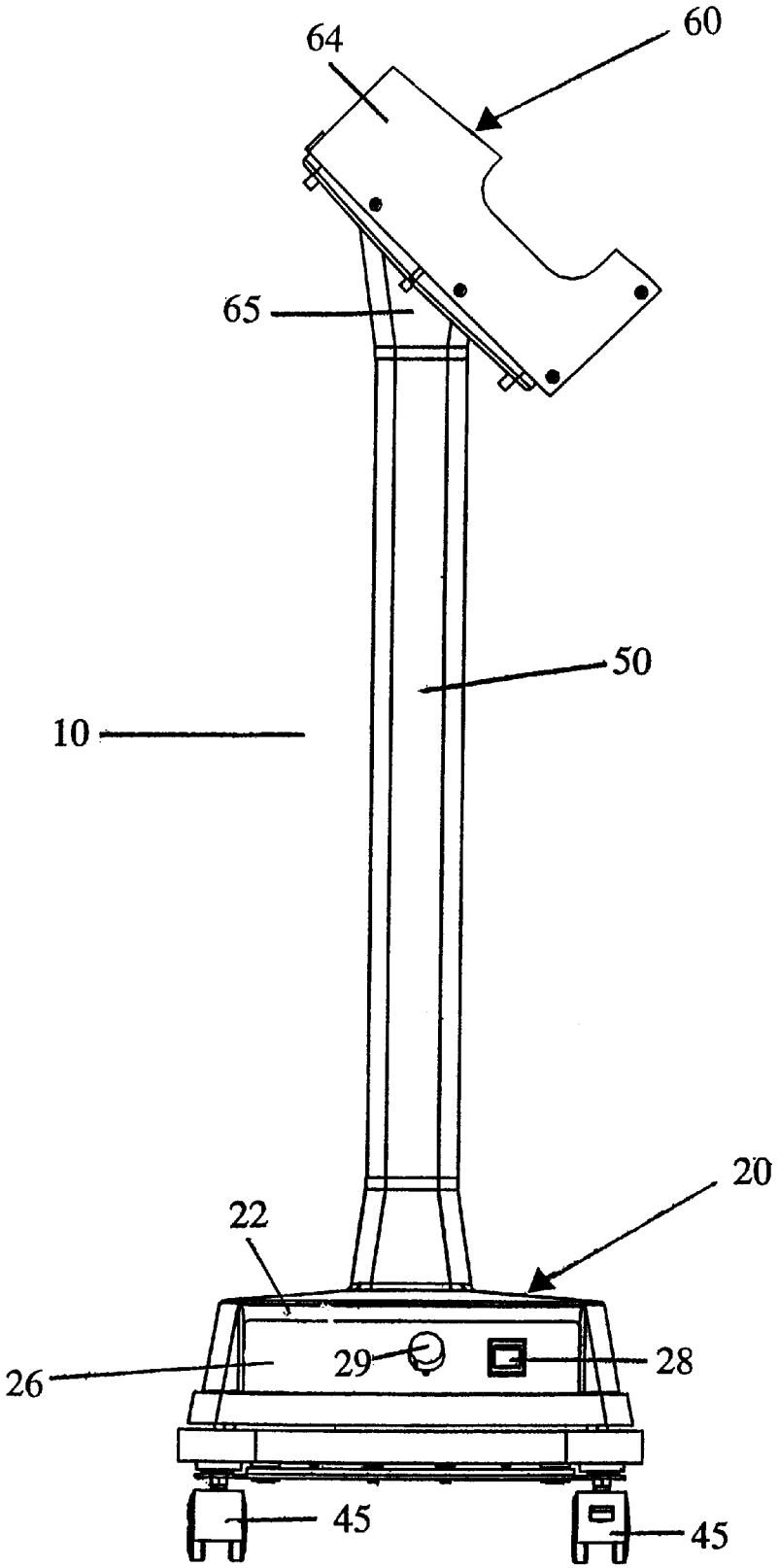
FIG. 3 is a side elevational view of the jogging device illustrated in FIG. 1.

The input bin 60 is attached to the top of the support column 50 as follows. A top cap 54 is fixedly connected to the top of the support column 50. The top cap 54 is bolted to a neck 65, which is most clearly seen in FIGS. 2 and 3. Preferably a gasket is disposed between the neck 65 and the top cap 54. The input bin 60, in turn, is bolted to the neck 65.

In the present instance, the input bin 60 is configured to receive several stacks of mail. The input bin includes a generally planar base plate 62, a sidewall 63 that is generally perpendicular to the base plate 62, and a plurality of divider walls 64 that divide the input bin 60 into a plurality of compartments. A stack of mail is placed into one of the compartments so that one the edge of the mail is disposed towards the base plate and one edge of the mail is supported by the sidewall 63. When the vibrating element of the device is on, the device 10 jogs the stack of mail until one edge of the pieces of mail in the stack engage the base plate 62 and a second edge of the pieces engage the sidewall 63. In this way, pieces in a stack of mail are justified along two edges.

Configured as described above, several advantages of the improved jogging apparatus are apparent. The vibrating element is significantly lowered, thereby lowering the center of gravity of the device. This improves the stability of the device, thereby improving the transportability of the device. In addition, by lowering the vibrating element and separating it from the input bin, the noise recognized by the operator is significantly reduced.

While particular embodiments of the invention have been herein illustrated and described, it is not intended to limit the invention to such disclosures, but changes and modifications may be made therein and thereto. For instance, an alternate vibrating element can be utilized. One alternate vibrating element incorporates an AC motor with an off-balanced rotor. A weight is attached to the rotor shaft so that the center of gravity of the rotor and weight to not aligned with the center of the rotor. This imbalance creates vibrations when the motor is run. Further, in the foregoing description, the device is described in connection with jogging documents such as mail. The jogging device can also be used in numerous other environments to settle or align items. Accordingly, the input bin 60 can be modified to accommodate various alternate items. For example, the input bin could be configured to the shape of a typical four-sided bin, or even flat plate.

What is claimed is:

1. An apparatus for jogging elements, comprising:

a base having a height and a vibrating element, wherein the vibrating element comprising:

an electromagnet for providing a variable magnetic field;

an armature separated from the electromagnet, wherein the magnetic attraction between the armature and the electromagnet varies as the magnetic field varies; and a resiliently compressible spacer disposed between the armature and the electromagnet, biasing the armature away from the electromagnet;

an input bin for receiving articles to be jogged;

an elongated member connecting the input bin and the base, transferring the vibrations from the vibrating element to the input bin, and separating the input bin from the vibrating element, wherein the elongated member has a height that is greater than the height of the base;

wherein the vibrating element creates vibrations that act upon the elements in the input bin to jog the elements.

2. The apparatus of claim 1 wherein the base has a height and the height of the elongated member greater than twice the height of the base.

3. The device of claim 1, wherein the input bin includes a wall for engaging and aligning the items jogged by the apparatus.

4. The apparatus of claim 1 wherein the device is operable in a work area having a floor and the apparatus comprises comprising a dampener disposed between the vibrating element and the floor.

5. The apparatus of claim 1 comprising a plurality of rollers.

6. An apparatus for jogging elements, comprising:

a vibrating element operable to provide vibrations;

an input bin for receiving the elements to be jogged; and an elongated member disposed between the vibrating element and the input bin, separating the input bin from the vibrating element, wherein the elongated member has a height and a width and the height of the elongated member is greater than the width of the elongated member;

wherein the vibrating element creates vibrations that act upon the elements in the input bin to jog the elements.

7. The apparatus of claim 6 comprising a base having a height, wherein the height of the elongated member is greater than the height of the base.

8. The apparatus of claim 6 comprising a base having a height, wherein the height of the elongated member is greater than twice the height of the base.

9. The apparatus of claim 6, wherein the input bin includes a wall for engaging and aligning the items jogged by the apparatus.

10. The apparatus of claim 6 comprising a plurality of rollers.

11. An apparatus for jogging elements, wherein the apparatus is operable in a work area having a floor, the apparatus comprising:

a base in operative engagement with the floor, the base including a vibrating element operable to provide vibrations;

an input bin for receiving the elements to be jogged; and an elongated member connecting the input bin and the base, transferring the vibrations from the vibrating element to the input bin, and separating the input bin from the vibrating element wherein the elongated member has a height and a width, and the height of the elongated member is greater than the width of the elongated member;

wherein the vibrating element creates vibrations that act upon the elements in the input bin to jog the elements.

12. The apparatus of claim 11 wherein the base has a height and the elongated member has a height, and the height of the elongated member is greater than twice the height of the base.

13. The apparatus of claim 11 wherein the base has a height and the elongated member has a height, and the height of the elongated member is greater than twice the height of the base.

14. The apparatus of claim 11, wherein the input bin includes a wall for engaging an aligning the items jogged by the apparatus.

15. The apparatus of claim 11 comprising a dampener disposed between the vibrating element and the floor.

16. The apparatus of claim 11 comprising a plurality of rollers.

17. The apparatus of claim 1 wherein the elongated member has a width, and the height of the elongated member is greater than the width of the elongated member.

18. The apparatus of claim 7 wherein the vibrating element is disposed within the base.

* * * * *

UNITED STATES PATENT AND TRADEMARK OFFICE

CERTIFICATE OF CORRECTION

PATENT NO. : 6,364,310 B1
DATED : April 10, 2002
INVENTOR(S) : Forbes

It is certified that error appears in the above-identified patent and that said Letters Patent is hereby corrected as shown below:

Column 3,
Line 61, “comprising” should read -- comprises --;

Column 4,
Line 14, “member greater” should read -- member is greater --;
Line 66, delete “twice”;

Signed and Sealed this

Third Day of September, 2002

*Attest:*

*Attesting Officer*

JAMES E. ROGAN
*Director of the United States Patent and Trademark Office*